United States Patent [19]

Fischer et al.

[11] 4,425,957

[45] Jan. 17, 1984

[54] METERING FUEL SUPPLY TO A SAND PACKING COMBUSTION CHAMBER

[75] Inventors: Kurt Fischer, Schaffhausen; Franz Mueller, Neuhausen am Rheinfall, both of Switzerland

[73] Assignee: George Fischer Aktiengesellschaft, Switzerland

[21] Appl. No.: 341,011

[22] Filed: Jan. 20, 1982

[30] Foreign Application Priority Data

Jan. 23, 1981 [CH] Switzerland ..... 435/81

[51] Int. Cl.[3] ..... B22C 15/00

[52] U.S. Cl. ..... 164/37; 164/169

[58] Field of Search ..... 164/37, 169; 100/911; 29/421 E; 72/706; 264/84; 425/1

[56] References Cited

U.S. PATENT DOCUMENTS 3,170,202 2/1965 Huston, Sr. et al. ..... 164/37

4,306,609 12/1981 Fischer et al. ..... 164/37

FOREIGN PATENT DOCUMENTS 55-147454 11/1980 Japan ..... 164/37

*Primary Examiner*—Kuang Y. Lin

*Assistant Examiner*—J. Reed Batten, Jr.

*Attorney, Agent, or Firm*—Roylance, Abrams, Berdo & Goodman

[57] ABSTRACT

In a molding machine for producing foundry sand molds the sand is compressed or packed by means of a pressure wave acting on the sand surface produced by explosive combustion of a mixture of fuel and air. The dosing of the fuel to be burned is carried out by a pressure regulated supply pipe, in which a dosing container is filled with fuel, e.g., gas, up to an exactly defined excess pressure. This fuel or gas is thereafter fed to the combustion chamber under relief of the gas pressure in the dosing container down to a lower pressure level.

15 Claims, 1 Drawing Figure

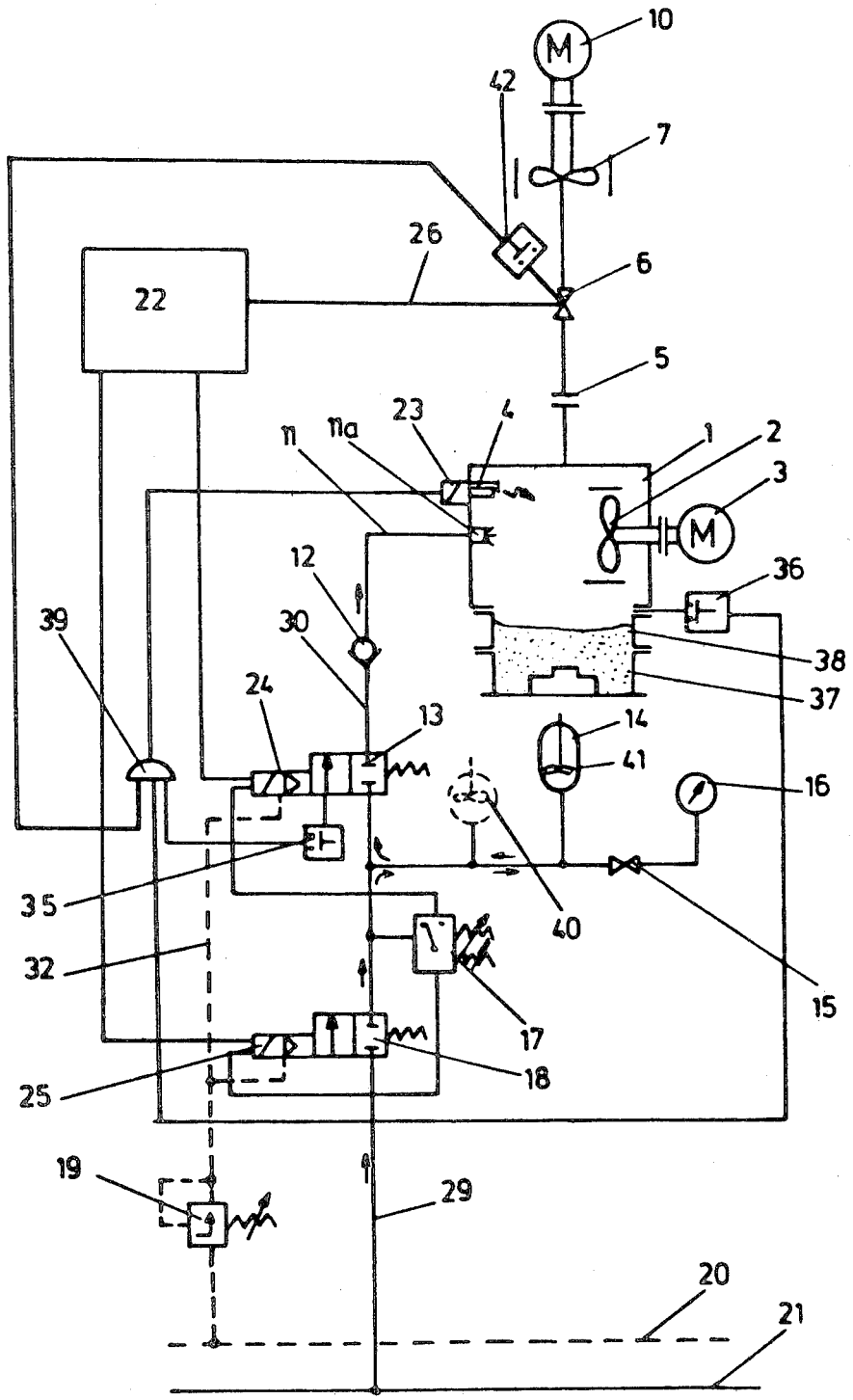
10
M
42
7
26
22
6
5
23
4
1
2
3
M
36
38
37
12
39
30
24
13
14
41
16
35
40
15
32
17
18
25
19
29
20
21

METERING FUEL SUPPLY TO A SAND PACKING COMBUSTION CHAMBER

This invention relates to a method and apparatus for metering or dosing fuel supplied to a combustion chamber in which reaction of the fuel is used to compact sand in the process of making a foundry mold.

BACKGROUND OF THE INVENTION

A number of methods for packing sand molds in foundries are already known, including designs in which a pressure impulse for packing the foundry sand is produced by an exothermic reaction of a gas. Because the fuel gas must be supplied to the combustion chamber in predetermined quantities or mixture proportions in order to obtain the same degree of compaction for all molds, the prior art includes two different quantity measurement principles.

According to one of these principles, the gas is received from a gas source at a constant pressure for a definite interval of time through a defined flow resistance so that a defined gas volume at normal pressure, or a defined quantity by weight, is received. In accordance with the other principle, the volume is directly measured by means of a gas meter. In either case, the measurements are rather inexact so that variations in the fuel mixture occurred, resulting in non-reproducible degrees of compaction of the molds. In the first case, obtaining constant pressure within narrow limits is possible only with large and expensive control and monitoring equipment. In the second case, the pressure is not at all controlled and it is just assumed that the pressure is constant, an assumption which is generally not correct. However, the major disadvantage of these known methods is the fact that the operating procedures are too slow and, consequently, can not be used in fixed-cycle molding machinery.

BRIEF DESCRIPTION OF THE INVENTION

Accordingly, an object of the present invention is to provide a method and an apparatus for metering or dosing the fuel supply for packing sand molds in foundries so that the disadvantages of the known methods and apparatuses are eliminated.

A further object is to provide such a method and apparatus so that, in a simple fashion, a constant-weight quantity of fuel can be supplied to the combustion chamber within a short interval of time.

Briefly described, the invention includes a method for supplying an accurately predetermined quantity of a fuel, or a mixture of fuels, to a combustion chamber forming part of an apparatus for producing foundry molds of the type wherein a quantity of molding sand to be compacted has a surface exposed to the combustion chamber, the method comprising the steps of providing a dosing container having a predetermined interior volume which is separated from the combustion chamber, filling the dosing container with fuel or mixture of fuels under pressures until the pressure therein reaches a predetermined level above the level of pressure in the combustion chamber, conducting the fuel from the dosing container into the combustion chamber until the pressure in the dosing container falls to a predetermined lower pressure level and igniting the fuel in the chamber to create an exothermic reaction.

In another aspect, the invention includes an apparatus for producing foundry sand molds of the type comprising a molding chamber containing sand to be compacted to form a mold, the sand having an exposed upper surface, a combustion chamber coupled to the molding chamber for receiving fuels to be reacted to compact the sand, and means for supplying fuel to said combustion chamber, comprising the combination of a source of fuel at a pressure greater than the normal pressure of the combustion chamber, supply conduit means for delivering fuel from said source to said combustion chamber, a dosing container coupled to said supply conduit means, valve means for selectively connecting said dosing container to said supply conduit means during a filling phase for filling said dosing container with fuel and to said combustion chamber during a loading phase for loading fuel from said dosing container into said combustion chamber, pressure sensing means coupled to said container responsive to upper and lower fuel pressures therein, respectively, for activating said valve means to terminate said filling phase at said upper pressure and said loading phase at said lower pressure.

In order that the manner in which the foregoing and other objects are attained in accordance with the invention can be understood in detail, particularly advantageous embodiments thereof will be described with reference to the accompanying drawings, which form a part of this specification, and wherein the drawing is a schematic block diagram of a metering system in accordance with the invention.

The apparatus schematically illustrated includes a combustion chamber 1 which forms part of a mold-making machine, the combustion chamber having an open side. A blower 2 is provided in the chamber and is driven by a motor 3, the blower or agitator being used to mix fuel supplied to the chamber with the air therein to reach an optimal burning condition.

The open side of the combustion chamber is coupled to a molding box or flask 37 which is filled with sand, and by a sand frame 38 which is placed on the flask. The fuel mixture is supplied to the interior volume of the combustion chamber 1 and is ignited by means of a spark plug 4 so that an exothermic reaction occurs.

For use during the sand compaction phase of the work cycle of the mold production process, the combustion chamber 1 is provided with a supply of fuel through a conduit system 11 and an inlet nozzle 11*a*, an ignition device 23 with its spark plug 4, and, in appropriate cases, with a flushing system for removing the exhaust or burned gases. These gases can also be removed through the open side of combustion chamber 1 in which case blower 2 can be used for flushing the open chamber.

The flushing apparatus can comprise a flushing ventilating fan 7 driven by a motor 10 and connected to the combustion chamber 1 through a connector 5 and a controllable valve 6 which is coupled to and controlled by a central control unit 22 by means of a pipe or cable 26. Motor 10 can also be operated from central control 22.

The fuel supply system includes a supply pipe 29 which either leads directly from a pressure supply pipe 21 of a distribution system, or from a compressor or a supply container which is steadily supplied with fuel. If a liquid or solid fuel is being used, the supply is delivered by a preparation plant which is not described here in detail.

A switching valve 18 is connected to the supply line 29 and can be electrically or electro-pneumatically operated. Valve 18 is connected to a pressure limiting switch 17 which can be adjusted to operate at upper and lower pressure limits. Valve 18 is also connected to central control 22. Preferably, a pressure limiting switch 17 with very narrow switching hysteresis characteristics is used.

Downstream of switching valve 18 is a dosing container 14 which is coupled to a pressure gauge 16 for reading the adjusted gas pressure of the container. Gauge 16 can be supplied with a valve 15 for turning off the gauge. If dust is being used as a component of the fuel, dosing container 14 is additionally equipped with a homogenization device such as a mixing blade or agitator 41. Also, if several components are being used, a mixing container 40 can be located on the entry side of dosing container 14 for mixing the fuel components. If the mixing takes place in the combustion chamber, especially when gases are used, a separate dosing container is required for each fuel.

By maintaining the relationship of the fuel to the oxidation means (i.e., air) at a certain level, it is advantageous to adjust the temperature of the combustion chamber and the dosing container relative to each other. An arrangement which has proven to be advantageous is one in which the dosing container is formed as part of the combustion chamber, e.g., wherein the dosing container is formed as a jacket around a supply pipe 14*a*.

A valve 13 for suppling fuel to combustion chamber 1 is located between the dosing container 14 and the combustion chamber 1 and is connected with central control 22 through a first auxiliary control 24.

A control signal which constitutes the opening impulse for supply valve 18 is provided from central control 22, and a closing impulse is provided by the pressure limiting switch 17 through an auxiliary control 25. A check valve 12 is series-connected between supply valve 13 and the combustion chamber 1. Valve 12 permits flow only in the direction toward the combustion chamber and thus blocks the explosion pressure emerging from combustion chamber 1 to protect valve 13 against the high temperatures of the combustion gases.

A pressure regulator 19 can be mounted in the pressure pipe 32 in order to maintain the air pressure for the operation of valve 13 and 18 at a constant level in the event of variations of the pressure in supply pipe 20 when the valves are pneumatically operated.

Supply valve 13 is equipped with a switch 35 which is closed in the closed position of the valve. This switch 35 provides a control pulse to the ignition device 23 so that the spark plug 4 can be ignited. The supply line 30 is connected to the combustion chamber 1 through a jet opening 11*a*.

Preferably, an interlock switch 36 is located between the lower edge of the open portion of combustion chamber 1 and the upper edge of the sand frame 38. The purpose of switch 36 is to permit the commencement of ignition by switch 35 only if switch 36 is in its closed position. On the other hand, injection of fuel into the combustion chamber 1 should be possible only if switch 36 is closed, i.e., when sand frame 38 and the molding box 37 hold the combustion chamber 1 firmly closed at its open side. The same is true when valve 6 of the flushing device is closed and switch 42 operated thereby is in the closed position. For this purpose, the signals from switches 35,36 and 42 are supplied to a logical AND-circuit 39 which provides an output only when all three switches are in their proper positions.

The operation of the apparatus thus described is as follows: the dosing container 14 is filled by means of valve 18 up to a predetermined pressure level, for example, 3 atmospheres gauge pressure with a pressurized gas. This is referred to as the filling phase. When this predetermined pressure level has been reached, the pressure limiting switch 17 produces a signal which closes valve 18, turning off the gas supply. Combustion chamber 1 is then ventilated with fresh air by means of blower 2 and is subsequently closed by the mold box 37 and sand frame 38. Gas is then supplied by opening valve 13 to the combustion chamber which now includes that portion of the sand frame to which the upper surface of the mold sand is exposed. The fuel is delivered from dosing container 14 until a low pressure level therein has been reached. When this lower pressure level has been reached, the pressure limiting switch turns off the supply by closing valve 13 and, after a predetermined interval, an electrical impulse is supplied to ignition device 23 so that the injected gas is caused to react exothermically, compacting the sand.

When valve 13 has been closed, valve 18 is again opened so that the dosing container 14 can again be filled to the upper pressure level. As soon as this level has been reached, the pressure limiting switch 17 interrupts the supply. The use of a switch 17 with particularly narrow switching hysteresis characteristics guarantees exact dosing of the gas.

At a chosen portion of the fuel mixture and at a given volume relationship between the combustion chamber volume and the dosing container volume, the final end pressure in the dosing container can be defined. Typical values for the upper and lower pressure levels are, for example, 3 and 0.5 atmospheres excess pressure (gauge pressure) when using natural gas.

When the dosing container is being fed from a city gas distribution system with a pressure of 3.5 atmospheres gauge pressure, it is easy to reach 3 atmospheres in the dosing container. This is also true when using a supply container with reducible excess pressure. When, however, a compressor is being used it is, from an energy consumption point of view, preferable to use a lower gauge pressure in the dosing container but a larger size container.

The supply of gas or other fuel to the combustion volume takes place in two steps, one being the filling step and other being the loading step during which fuel is fed from the dosing container to the combustion chamber. In the filling phase, the dosing container is filled relatively slowly up to an exactly predetermined upper pressure level. In the loading phase, however, the gas is very rapidly transferred from the dosing container to the combustion chamber until the pressure level in the dosing container reaches the predetermined lower level.

By means of such a technique, an exact determination of the consistency of the air-gas mixture is possible so that a clean combustion and reproducible compacting degree of the sand are guaranteed.

While certain advantageous embodiments have been chosen to illustrate the invention it will be understood by those skilled in the art that various changes and modifications can be made therein without departing from the scope of the invention as defined in the appended claims.

What is claimed is:

1. A method for supplying an accurately predetermined quantity of a fuel, or a mixture of fuels, to a combustion chamber forming part of an apparatus for producing foundry molds of the type wherein a quantity of molding sand to be compacted has a surface exposed to the combustion chamber, the method comprising the steps of providing a dosing container having a predetermined interior volume which is separated from the combustion chamber, filling the dosing container with fuel or mixture of fuels under pressures until the pressure therein reaches a predetermined level above the level of pressure in the combustion chamber, conducting the fuel from the dosing container into the combustion chamber until the pressure in the dosing container falls to a predetermined lower pressure level and igniting the fuel in the chamber to create an exothermic reaction.

2. A method according to claim 1 which further includes, before conducting the fuel from the dosing container, the steps of ventilating the combustion chamber with fresh air, and raising the pressure therein to atmospheric pressure;

and wherein a plurality of dosing containers with a plurality of fuels are provided, the fuels being conducted from all said containers to the chamber.

3. A method according to claim 2 wherein each component of a fuel mixture is supplied to the combustion chamber from a separate dosing container.

4. A method according to claim 3 wherein at least one component is a gas.

5. A method according to claim 3 wherein at least one component is a liquid.

6. A method according to claim 3 wherein at least one component is a solid.

7. A method according to any of claims 1, 2, 3 or 4 wherein the predetermined levels of pressure in the dosing container are selected in dependence upon the difference between the operating temperatures of the dosing container and the combustion chamber.

8. A method according to any of claims 1, 2, 3 or 4 wherein the dosing container and combustion chamber are brought to substantially the same temperature.

9. An apparatus for producing foundry sand molds of the type comprising a molding chamber containing sand to be compacted to form a mold, the sand having an exposed upper surface, a combustion chamber coupled to the molding chamber for receiving fuels to be reacted to compact the sand, and means for supplying fuel to said combustion chamber, comprising the combination of:

a source of fuel at a pressure greater than the normal pressure of the combustion chamber;

supply conduit means for delivering fuel from said source to said combustion chamber;

a dosing container coupled to said supply conduit means;

valve means for selectively connecting said dosing container to said supply conduit means during a filling phase for filling said dosing container with fuel and to said combustion chamber during a loading phase for loading fuel from said dosing container into said combustion chamber;

pressure sensing means coupled to said container responsive to upper and lower fuel pressures therein, respectively, for activating said valve means to terminate said filling phase at said upper pressure and said loading phase at said lower pressure.

10. An apparatus according to claim 9 wherein said valve means includes first and second switching valves, and control means responsive to said pressure sensing means for controlling said switching valves.

11. An apparatus according to claim 10 wherein said pressure sensing means includes a pressure responsive switch connected between said switching valves.

12. An apparatus according to claim 9 and further comprising a mixing container for receiving and mixing plural fuel components, said mixing container being coupled to said conduit means.

13. An apparatus according to claim 9 and further comprising a check valve connected in the flow path between said dosing container and said combustion chamber to permit flow of fuel only in the direction toward said chamber.

14. An apparatus according to claim 9 wherein said dosing container includes means therein for mixing fuel supplied to said container.

15. An apparatus according to claim 9 wherein the structure forming said dosing container is formed as part of said combustion chamber.

* * * * *